US011282621B2

(12) United States Patent
Matsubara et al.

(10) Patent No.: US 11,282,621 B2
(45) Date of Patent: Mar. 22, 2022

(54) RESISTOR AND CIRCUIT SUBSTRATE

(71) Applicant: KOA Corporation, Nagano (JP)

(72) Inventors: Shuhei Matsubara, Ina (JP); Keishi Nakamura, Ina (JP)

(73) Assignee: KOA CORPORATION, Nagano (JP)

( * ) Notice: Subject to any disclaimer, the term of this patent is extended or adjusted under 35 U.S.C. 154(b) by 0 days.

(21) Appl. No.: 17/257,971

(22) PCT Filed: Jun. 21, 2019

(86) PCT No.: PCT/JP2019/024796

§ 371 (c)(1),
(2) Date: Jan. 5, 2021

(87) PCT Pub. No.: WO2020/012926

PCT Pub. Date: Jan. 16, 2020

(65) Prior Publication Data

US 2021/0225562 A1 Jul. 22, 2021

(30) Foreign Application Priority Data

Jul. 12, 2018 (JP) ..... JP2018-132594

(51) Int. Cl.
*H01C 1/012* (2006.01)
*H01C 1/144* (2006.01)

(52) U.S. Cl.
CPC ..... *H01C 1/012* (2013.01); *H01C 1/144* (2013.01)

(58) Field of Classification Search
CPC ..... H01C 1/012; H01C 1/144
See application file for complete search history.

(56) References Cited

U.S. PATENT DOCUMENTS 4,742,325 A * 5/1988 Muller ..... H01C 17/288 338/309
5,468,672 A * 11/1995 Rosvold ..... H01C 7/006 204/192.21
6,489,881 B1 * 12/2002 Aleksandravicius ..... H01L 27/0802 257/E27.047
2004/0031311 A1 * 2/2004 Meyer ..... F16C 17/24 73/7
2004/0262367 A1 * 12/2004 Nakamura ..... H05K 3/06 228/122.1
2010/0060409 A1 * 3/2010 Smith ..... H01C 17/24 338/262

FOREIGN PATENT DOCUMENTS

CN 1106952 A 8/1995
CN 101430955 A 5/2009
(Continued)

OTHER PUBLICATIONS

International Search Report, Application No. PCT/JP2019/024796, dated Sep. 10, 2019. ISA/Japan Patent Office.

*Primary Examiner* — Kyung S Lee
(74) *Attorney, Agent, or Firm* — Honigman LLP

(57) ABSTRACT

A resistor according to the present disclosure includes an insulated substrate, a resistive layer formed of a resistance body material and a bonding layer for bonding the insulated substrate and the resistive layer, wherein the resistor is configured so that a ratio of a sheet resistance of the bonding layer to a sheet resistance of the resistive layer is 100 or more.

10 Claims, 5 Drawing Sheets

(56) References Cited

FOREIGN PATENT DOCUMENTS

| | | | |
|---|---|---|---|
| CN | 107109613 | A | 8/2017 |
| JP | H11-097203 | A | 4/1999 |
| JP | 2002075705 | A | 3/2002 |
| JP | 2005078874 | A | 3/2005 |
| JP | 2015170727 | A | 9/2015 |

* cited by examiner

RESISTOR AND CIRCUIT SUBSTRATE

CROSS-REFERENCE TO RELATED APPLICATIONS

This application is the U.S. national stage of PCT/JP2019/024796 filed on Jun. 21, 2019, which claims priority of Japanese Patent Application No. JP 2018-132594 filed on Jul. 12, 2018, the contents of which are incorporated herein.

TECHNICAL FIELD

The present disclosure relates to a resistor and a circuit substrate.

BACKGROUND ART

In recent years, with the sophistication of electronic devices, high power requirements and high heat resistance requirements for circuit substrate for mounting electronic components are increasing. On the other hand, a circuit board obtained by connecting an activated copper foil directly to a ceramic substrate using a solder material, etc., and brazing a resistor (shunt resistor element) formed into a sheet form on the resulting substrate has been proposed (see JPH11-097203A). In this circuit substrate, the heat generated from the resistance body is formed in the form of a sheet, so the heat generated from the resistance body can be easily dissipated through the substrate

SUMMARY

In the circuit substrate as described above, the activated metal method is used to bond the resistor to the substrate. In addition, a conductive material is used as the solder material and is generally formed thicker. Therefore, although the heat dissipation is improved in the circuit substrate as described above, the solder material may be a factor that makes the resistance characteristic unstable. Thus, under the situation where the stabilization of resistance characteristics is required at a high level as electronic devices become more sophisticated, there was room for further improvement in the mounting of the resistor on the circuit substrate.

It is an object of the present disclosure to provide a resistor and a circuit substrate in which the stabilization of the resistive properties can be achieved at a higher level and the resistor is formed.

According to an aspect of the present disclosure, a resistor including an insulated substrate, a resistive layer formed of a resistive body material, and a bonding layer for bonding the insulated substrate and the resistive layer, wherein the resistor is configured so that a ratio of a sheet resistance of the bonding layer to a sheet resistance of the resistive layer is 100 or more.

According to this aspect, by bonding the resistive layer to the insulated substrate via the bonding layer, the heat generated from the resistive layer can be easily dissipated from the insulated substrate with high thermal conductivity. Furthermore, by forming the resistive layer so that the ratio of the sheet resistance of the bonding layer to the sheet resistance of the resistive layer (resistance ratio) is 100 or more, the variation amount of the temperature resistance characteristic of the resistive body can be kept within a predetermined range, thus providing a stable resistance characteristic.

Therefore, it is possible to provide the resistor capable of stabilizing the resistive properties at a higher level, and the circuit substrate in which the resistor is formed.

DETAILED DESCRIPTION OF PREFERRED EMBODIMENTS

Explanation of Resistor

Figure 1:
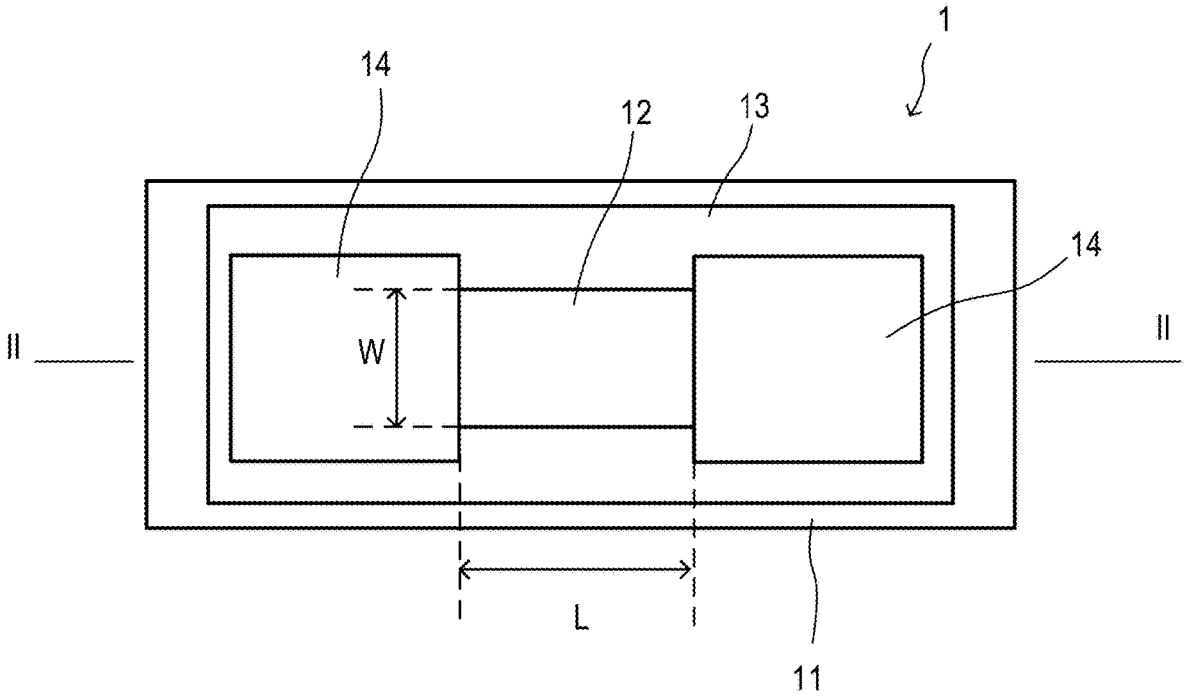
FIG. 1 is a plan view showing a resistor according to an embodiment of the present disclosure.

A resistor 1 according to an embodiment of the present disclosure will be described in detail using the drawings. FIG. 1 is a plan view of the resistor 1 according to an embodiment of the present disclosure. And FIG. 2 is a sectional view of the resistor 1 in II-II line shown in FIG. 1.

The resistor 1 includes an insulated substrate 11, a resistive layer 12 formed of a resistive material, and a bonding layer 13 for bonding the insulated substrate 11 and the resistive layer 12. The bonding layer 13 is formed of at least one metal selected from the group consisting of titanium, aluminum, nickel and chromium.

In the resistor 1, the ratio of a sheet resistance of the bonding layer 13 to a sheet resistance of the resistive layer 12 is 100 or more. The resistor 1 also includes two conductor layer 14 on the face of the bonding layer 13 partially overlapping the resistive layer 12. The resistor 1 is used with each of the conductor layer 14 connected to a circuit pattern not shown in FIG. 1.

Figure 2:
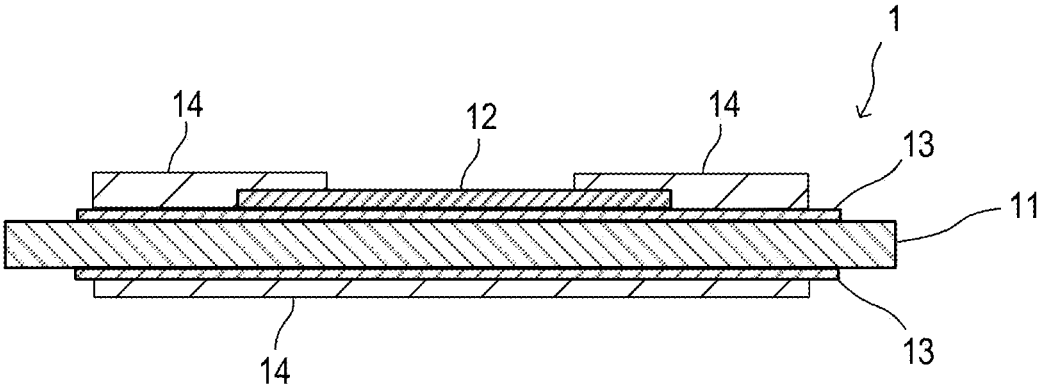
FIG. 2 is a sectional view showing the resistor according to an embodiment of the present disclosure.

Further, as shown in FIG. 2, the resistor 1 according to the present embodiment, in order to balance the thermal stresses applied to the front and rear surfaces of the resistor 1, the bonding layer 13 and the conductor layer 14 are formed on both surfaces of the insulated substrate 11.

The resistance value of the resistor 1 can be set by a thickness of the resistive layer 12 formed on the insulated substrate 11, a width W of the resistive layer 12, and a spacing L of the conductor layer 14 respectively disposed at both ends of the resistive layer 12.

Then, the respective configurations of the resistor 1 according to the present embodiment will be described in lamination order.

Insulated Substrate

The insulated substrate 11 is excellent in insulation and heat resistance, a substrate to be applied to high power applications and high heat generation applications. The insulated substrate 11 is formed using at least one ceramic material selected from the group consisting of aluminum oxide, silicon nitride, and aluminum nitride. Among these materials, from the viewpoint of heat dissipation and heat cycle durability, it is preferable to use aluminum oxide (hereinafter, sometimes referred to as alumina). Further, in applications where higher heat dissipation is required, it is preferable to select aluminum nitride with large thermal conductivity, in applications where high heat cycle durability is required, it is preferable to select silicon nitride.

A thickness of the insulated substrate 11 can be used 0.1 mm or more and 1.0 mm or less. From the viewpoint of strength as a substrate, the thickness of the insulated substrate 11 is preferably 0.1 mm or more. Further, from the viewpoint of heat dissipation, it is preferably 1.0 mm or less.

Bonding Layer

The bonding layer 13 is bonding the insulated substrate 11 and the resistive layer 12 and is disposed on the insulated substrate 11.

In the present embodiment, the material forming bonding layer 13 is at least one metallic material selected from the group consisting of titanium, aluminum, nickel and chromium, which may be used alone or in alloys. It is also possible to use an oxide of each of these metallic materials. As the metallic material for forming the bonding layer 13, titanium or aluminum is preferably used from the viewpoint of increasing the adhesion strength to the insulated substrate 11, and more preferably titanium is used.

In the resistor 1 according to the present embodiment, a thickness of the bonding layer 13 can be 50 nm or more and 1000 nm or less. The thickness of the bonding layer 13 is preferably 50 nm or more in order to obtain an adhesion strength between the insulated substrate 11 and the resistive layer 12. Further, from the viewpoint of resistance characteristics and cost effectiveness, it is preferably 1000 nm or less. The thickness of the bonding layer 13 is more preferably 50 nm or more and 200 nm or less in the above ranges from the viewpoints of adhesion strength and resistivity characteristics.

As a method of forming the bonding layer 13 on the surface of the insulated substrate 11, it is able to use a plating method, a vacuum deposition method, an ion-plating method, a sputtering method, a vapor deposition method, a cold-spray method, and the like. Resistive layer The resistive layer 12 is formed from a resistor material and is disposed in a predetermined position in the bonding layer 13. In the present embodiment, as the resistor material constituting the resistive layer 12, it is possible to use an alloy containing at least one metal selected from the group consisting of copper, nickel and manganese. Further, as the resistive material, in addition to the above-mentioned metallic material, it is usually applicable as long as it is the metallic material capable of constituting the resistive body.

The thickness of resistive layer 12 can be 20 μm or more and 1000 μm or less depending on the thickness of the entire resistor when incorporated in circuit substrate. The resistance value of the resistor 1 can be set by the thickness, the width W of the resistive layer 12 formed on the insulated substrate 11, and the spacing L of the conductor layer 14 disposed at the end of the resistive layer 12. The thickness of the resistive layer 12 is more preferably 50 μm or more and 500 μm or less in the above ranges based on the sizes and resistance values of the circuit substrate.

The resistor 1, for example, when used as a resistor for current sensing (so-called shunt resistor), among the resistor material capable of constituting resistive layer 12, the resistor material such as a manganin-alloy, a gelanin-alloy and a nichrome can be used as a main component.

Further, from the viewpoint of good performance can be obtained as a resistor, it is possible to use the manganin-alloy and the gelanin-alloy. Furthermore, it is preferable to use the manganin-alloy from the viewpoint of workability in forming at the thickness described above on the bonding layer 13.

As a method of forming the resistive layer 12 on the surface of the bonding layer 13, it is able to use the plating method, the vacuum deposition method, the ion-plating method, the sputtering method, the vapor deposition method, the cold-spray method, and the like. Conductor layer The conductor layer 14 is disposed on the bonding layer 13 and on both sides of the resistive layer 12. In this embodiment, it can use copper as a conductive material for forming the conductor layer 14. Further, in addition to copper, it can be used any material be able to use for forming the circuit pattern.

A thickness of the conductor layer 14 can be several tens of micrometers to several hundred micrometers, and shapes corresponding to large current applications can be appropriately applied.

As a method of forming the conductor layer 14, it is able to use the plating method, the vacuum deposition method, the ion-plating method, the sputtering method, the vapor deposition method, the cold-spray method, and the like.

Layer Structure

As shown in FIG. 1, the resistor 1, in the overlapping portion between the conductor layer 14 and the resistive layer 12, constitutes by laminated the bonding layer 13, the resistive layer 12 and the conductor layer 14 to the insulated substrate 11 by this order. This laminated structure can be achieved by forming the bonding layer 13 on the insulated substrate 11 by the method described above, followed by forming the resistive layer 12 on the bonding layer 13 by the method described above with masked regions other than the region where the resistive layer 12 is to be formed, and further by forming the conductor layer 14 by the method described above with masked regions other than the region where the conductor layer 14 is to be formed.

Figure 3:
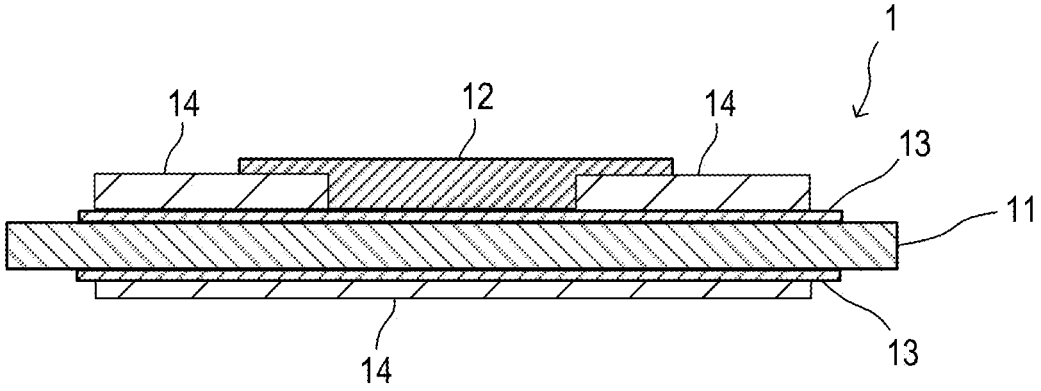
FIG. 3 is a sectional view showing a modification of resistor.

FIG. 3 is a cross-sectional view illustrating a modification of the resistor 1. As shown in FIG. 3, the resistor 1, in the overlapping portion between the conductor layer 14 and the resistive layer 12, constitutes by laminated the bonding layer 13, the conductor layer 14 and the resistive layer 12 to the insulated substrate 11 by this order. This laminated structure can be achieved by forming the bonding layer 13 in the insulated substrate 11 by the method described above, followed by forming the conductor layer 14 on the bonding layer 13 by the method described above with masked regions other than the region where the conductor layer 14 is to be formed, and further forming the resistive layer 12 by the method described above with masked regions other than the region where the resistive layer 12 is to be formed.

Circuit Substrate

Figure 4:
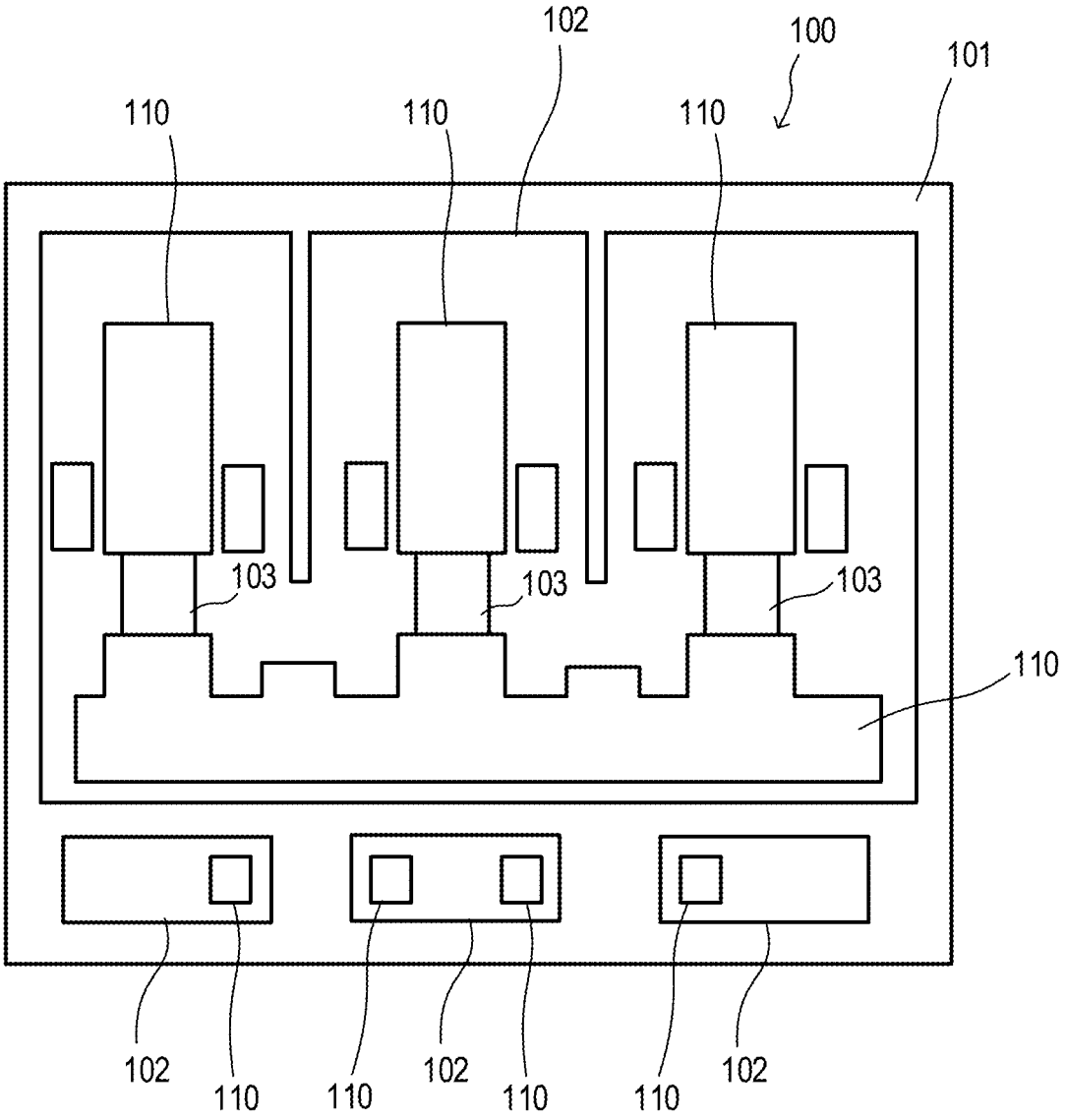
FIG. 4 is a plan view showing a circuit substrate according to an embodiment of the present disclosure.

A circuit substrate according to the present embodiment will be described. FIG. 4 is a plan view for explaining the circuit substrate according to the present embodiment.

A circuit substrate 100 shown in FIG. 4, constitutes by forming a circuit pattern 110 on the insulated substrate 101, and by forming the resistive layer 103 on the insulated substrate 101 via the bonding layer 102. The bonding layer 102 is formed of at least one metallic material selected from the group consisting of titanium, aluminum, nickel and chromium. Further, the resistive layer 103 is formed of a resistive material, and the circuit pattern 110 is formed on a surface of the bonding layer 102 by being overlapped on a part of the resistive layer 103.

The circuit substrate 100 is configured so that the ratio of the sheet resistance of the bonding layer 102 to the sheet resistance of the resistor 103 is 100 or more.

The circuit substrate 100 shown in FIG. 4, is achieved by forming the bonding layer 102 on the surface of the insulated substrate 101 by using the plating method, the vacuum deposition method, the ion plating method, the sputtering method, the vapor deposition method and the cold spray method or the like, subsequently, by forming the resistive layer 103 on the bonding layer 102 with masked regions other than the region where the resistive layer 103 is to be formed, and further by forming the circuit pattern 110 by the method described above with masked regions other than the region where the circuit pattern 110 is to be formed.

In a typical circuit substrate, a resistor was bonded by a brazing material at a predetermined position of the board on which circuit pattern was formed. On the other hand, according to the circuit substrate 100 according to the present embodiment, it is possible to form the resistive layer 103 on the insulated substrate 101 in a process of forming the circuit pattern into the insulated substrate 101. Therefore, when mounting the resistance body on the circuit substrate, it do not occur issues such as bonding strength between the substrate and the resistance body, or cracks in the bonding parts due to thermal stress.

Further, by a structure in which the resistive layer 103 is in close contact with the circuit substrate 100 as described above, the heat generation of the resistive layer 103 is easily radiated through the insulated substrate 101. Furthermore, since the resistive layer 103 can be integrally formed in the forming process of the circuit pattern 110, flexibility in designing the circuitry is increased.

EXAMPLES

A test specimen based on the resistor 1 according to an embodiment of the present disclosure was prepared and evaluated as the resistor 1 by performing various measurements. A method of producing the test specimen and its assessment will be described below.

Preparation of Test Specimens

An aluminum oxide (alumina) was used as the insulated substrate. A manganin was used as the resistor material. And, titanium and aluminum were respectively used as metallic materials for the bonding layer.

The bonding layer having a thickness of 100 nm was formed by applying the sputtering method using titanium or aluminum to an alumina substrate having a size of vertical 30 mm×horizontal 50 mm×thickness 1 mm Sputtering conditions was as follows.

Target: Titanium

Discharge gas: Argon gas

Gas flow rate: 50 sccm

Gas pressure: 0.7 Pa

DC Electric power: 1000 W

As the metallic material constituting the bonding layer, titanium was used, and for each, those having a thickness of 50 nm, 100 nm, and 1000 nm were prepared. In addition, the test specimen using aluminum as the bonding layer was prepared in the same way.

Subsequently, the resistive layer (mask size 10 mm×40 mm) was formed by applying the cold spray method using the manganin alloy as the resistor material on the bonding layer formed by applying the sputtering method.

Conditions of the cold spray method was as follows.

Working gas: Compressed nitrogen

Gas pressure: 1 to 6 MPa

Gas temperature: 400-450° C.

Spraying distance: 15 mm

Traverse speed: 20 to 80 mm/sec

Powder feed rate for thermal spraying Manganin: 10 to 30 g/min

By changing the conditions of the cold spray, the resistive layers were prepared with thicknesses of 20 μm, 200 μM and 1000 μm.

Several test specimens were fabricated by changing the thickness of resistive layer and combining the type and the thickness of bonding layer.

Evaluation Method

Heat Dissipation Test

Figure 5A:
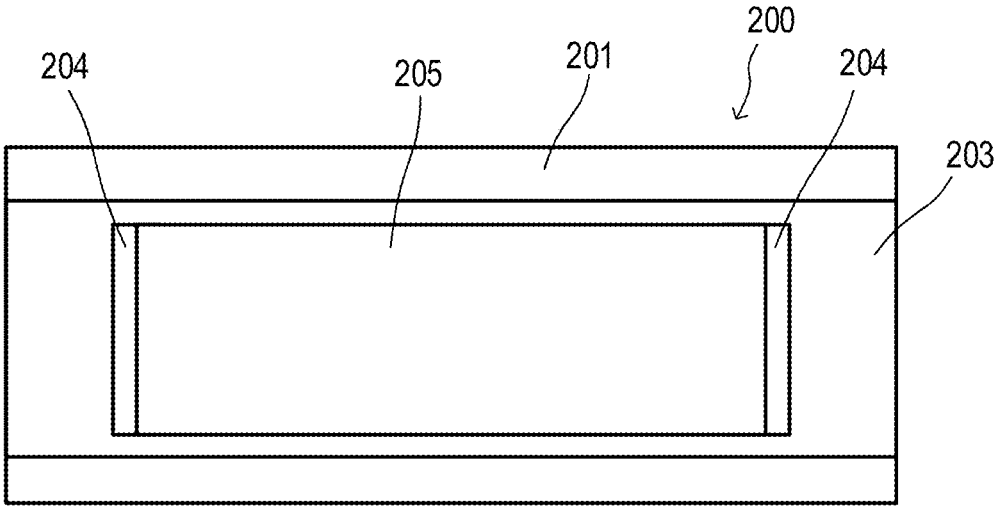
FIG. 5A is a plan view showing a conventional shunt resistor device.

As a comparative model, a typical shunt resistor device 200 with solder mounted on both ends of the resistor is used in ceramics substrate. FIG. 5A is a plan view illustrating a shunt resistor device 200, and FIG. 5B is a sectional view illustrating the shunt resistor device 200.

Figure 5B:
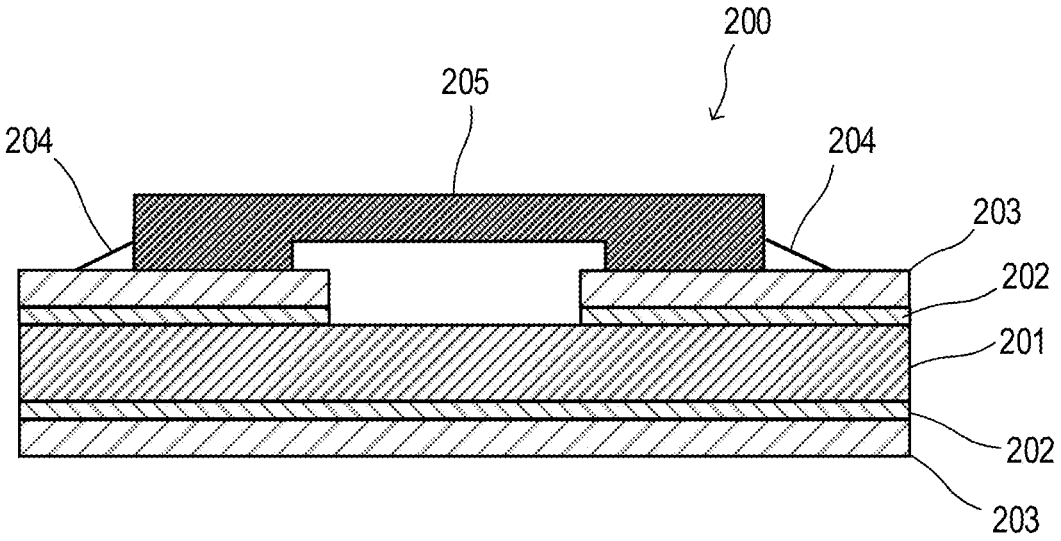
FIG. 5B is a sectional view showing the conventional shunt resistor device.

In the shunt resistor device 200 shown in FIG. 5A and FIG. 5B, two bonding layers 202 spaced apart on both sides of the ceramics substrate 201 is formed, further, a conductor pattern 203 is formed in each of bonding layers 202. At a predetermined position of the conductor pattern 203, a resistance body 205 is bonding by solder 204.

In shunt resistor device 200, the ceramics substrate 201 is the alumina substrate having a size of vertical 30 mm×horizontal 50 mm×thickness 1 mm, and the resistance body 205 is formed the alumina substrate having a size of vertical 6.35 mmx horizontal 3.18 mmx thickness 0.6 mm In the shunt resistor device 200, the resistance body 205 is mounting on the ceramics substrate 201 on the both end of own by solder, and other than the both end of the resistance body 205 does not contact to the ceramics substrate 201, constitutes an air insulation structure.

Further, as the resistor 1 according to the present embodiment, it was used that a test specimen T1 produced by the methods described above. The construction of the test specimen T1 is referred in FIG. 3.

The backside temperature of the shunt resistor device 200 was set to 25° C. and 2 W of power was applied. The same test was applied to test specimen T1.

According to the shunt resistor device 200, a temperature of a hot spot appearing in a central part of the resistance body 205 and a temperature of a terminal part where the resistance body 205 is connected to the ceramics substrate 201 were measured.

Also, according to the test specimen T1, a temperature of a hot spot appearing in a central part of the resistive layer and a temperature of the insulated substrate in the vicinity of the end of the resistive layer were measured. The results will be described later.

Resistor Structure and Resistance Temperature Characteristics

Test specimen obtained as described above was subjected to the following evaluation tests.

Calculation of Resistance Ratio

The ratio of the sheet resistance of the bonding layer to the sheet resistance of the resistive layer was calculated as follows. The sheet resistance is calculated as follows.

Sheet Resistance=Volume Resistivity (μΩ·cm)/Thickness (cm)

Resistance ratio={Sheet resistance of the bonding layer (μΩ/sq)}/{Sheet resistance of the resistive layer (μΩ/sq)}

Here, the volume resistivity of the manganin is 43μΩ·cm, the volume resistivity of titanium is 42.7μΩ·cm, the volume resistivity of aluminum is 2.8μΩ·cm.

Measurement of Resistance Temperature Characteristics of Resistors

A resistance temperature coefficient of the resistor (TCR) was measured to calculate the ratio of a change relative to a standard value. That is, regarding the resistance temperature coefficient of only the resistor, and the resistance temperature coefficient of a laminate as a substantial conductor, the laminate which obtained by combining the resistor and the bonding layer, it was calculated that the changing rate of change of the latter with respect to the former.

The resistance temperature coefficient (TCR) represents the ratio of the change in the internal resistance value due to the temperature change of the resistor, it is expressed by the following equation.

$$\text{Temperature coefficient of resistance (ppm/° C.)}=\{(R-Ra)/Ra\}\times\{1/(T-Ta)\}\times 1000000$$

In the above equation, Ta: the reference temperature, T: the temperature at which the steady-state, Ra: the resistance value of the resistor material at the reference temperature, R: the resistance value of the resistor material in the steady-state.

Further, the rate of change of the temperature coefficient of resistance (TCR) can be determined by the following equation.

$$\text{Changing rate of TCR (\%)}=\{(TCRb-TCRa)/TCRa\}\times 100$$

In the above equation, TCRa is the temperature coefficient of resistance of only the resistor, TCRb is the temperature coefficient of resistance when the lamination obtained by combining the resistor and the bonding layer is treated as a resistor.

If the value of the changing rate of TCR (%) is small, it becomes close to the characteristics of the resistor itself, indicating that the contribution of the bonding layer to the characteristics as a resistor is small. From this viewpoint, the changing rate of TCR (%) is preferably 20% or less. In the following evaluation, the test specimen having a value of the changing rate of TCR (%) of 20% or less was judged as "good", the test specimen having a value of the changing rate of those exceeding 20% was judged as "fail".

Evaluation Results

Result of Heat Dissipation Test

In the conventional resistor, the temperature of the hot spot in the center of the resistor was 74.2° C., and the temperature of the terminal portion was 27.8° C., and the temperature difference was 46.4° C. On the other hand, in test specimen T1, the temperature of the hot spot in the center of resistive layer was 28.6° C., and the temperature of ceramics substrate in the vicinity of the end of the resistive layer was 27.3° C., and the temperature difference was 1.3° C.

From this finding, in the resistor 1 shown in this embodiment, the resistive layer 12 is in close contact with the insulated substrate 11 through the bonding layer 13, it was found that the heat generated from the resistive layer 12 is easily radiated from the insulated substrate 11 with a high thermal conductivity.

Resistor Structure and Resistance Temperature Characteristics

The evaluation results of the test specimen regarding the resistor construction was shown in Table 1 and Table 2.

TABLE 1

| | | Number of test specimen | | | | | | | | |
|---|---|---|---|---|---|---|---|---|---|---|
| | | T1 | T2 | T3 | T4 | T5 | T6 | T7 | T8 | T9 |
| Resistor material | 20 (μm) | ○ | ○ | ○ | — | — | — | — | — | — |
| Manganin | 200 (μm) | — | — | — | ○ | ○ | ○ | — | — | — |
| | 1000 (μm) | — | — | — | — | — | — | ○ | ○ | ○ |
| Material for Bonding layer | 50 (nm) | ○ | — | — | ○ | — | — | ○ | — | — |
| | 100 (nm) | — | ○ | — | — | ○ | — | — | ○ | — |
| Titanium | 1000 (nm) | — | — | ○ | — | — | ○ | — | — | ○ |
| Resistance ratio | | 397.2 | 198.6 | 19.9 | 3972.1 | 1986 | 198.6 | 19861 | 9930.2 | 993 |
| Evaluation results | | Good | Good | Fail | Good | Good | Good | Good | Good | Good |

TABLE 2

| | | Number of test specimen | | | | | | | | |
|---|---|---|---|---|---|---|---|---|---|---|
| | | Al | A2 | A3 | A4 | A5 | A6 | A7 | A8 | A9 |
| Resistor material Manganin | 20 (μm) | ○ | ○ | ○ | — | — | — | — | — | — |
| | 200 (μm) | — | — | — | ○ | ○ | ○ | — | — | — |
| | 1000 (μm) | — | — | — | — | — | — | ○ | ○ | ○ |
| Material for Bonding layer Titanium | 50 (nm) | ○ | — | — | ○ | — | — | ○ | — | — |
| | 100 (nm) | — | ○ | — | — | ○ | — | — | ○ | — |
| | 1000 (nm) | — | — | ○ | — | — | ○ | — | — | ○ |
| Resistance ratio | | 26.2 | 13.1 | 1.0 | 262.3 | 130.9 | 9.5 | 1311.6 | 654.7 | 47.6 |
| Evaluation results | | Fail | Fail | Fail | Good | Good | Fail | Good | Good | Fail |

Results

According to the results shown in Table 1, a test specimen T3 obtained by combining a resistive layer having a thickness of 20 μm formed from cartoon and a bonding layer having a thickness of 1000 nm made of titanium was judged to be "Fail" because the changing rate of TCR (%) exceeded 20%, and the resistance ratio of this test specimen T3 was 19.9.

Further, according to the results shown in Table 2, for a resistive layer having a thickness of 20 μm formed from the manganin, when aluminum is used as the bonding layer material, the resistance ratio is less than 100 regardless of the thickness of the bonding layer, since the contribution of aluminum to TCR is large, it was judged to be "Fail". The resistance ratio at these test was 26.2, 13.1 and 1.0.

According to the above results, the resistor including the alumina substrate, the resistive layer formed of the manganin and the bonding layer formed of titanium or aluminum, formed so that the ratio of the sheet resistance of the bonding layer to the sheet resistance of the resistive layer (resistance ratio) is formed to be 100 or more, can make the changing rate of TCR within 20% or less of the allowable range, and it can be seen that stable resistance properties can be obtained.

That is, by making the ratio of the sheet resistance of the bonding layer more than 100 times the sheet resistance of the resistance body, the contribution of the bonding layer to properties of the resistor can be reduced to less than 1%. Further, since the temperature resistance characteristic of the titanium, aluminum, chromium, nickel, etc., used in the bonding layer is 3000-4000 ppm/° C., the effect of the bonding layer on the TCR of the resistor can be limited to 30-40 ppm/° C. This allows to ensure the properties necessary for the shunt resistor device. Furthermore, the results in Tables 1 and Table 2 show that when each layer of the resistance body has the same configuration, titanium as the bonding layer material provides a more stable resistance property.

According to the construction of the resistor 1, since there is no using solder, it is possible to increase the durability of the resistive layer 12 and the insulated substrate 11 without the bonding portion is damaged by thermal stress differences.

There is a difference between the thermal expansion coefficient of an insulated substrate, the thermal expansion coefficient of a component such as a resistance body that is mounted on the insulated substrate, and the thermal expansion coefficient of a conductor pattern. This causes cyclic fatigue to accumulate at the bonding between the insulated substrate and the resistance body, or between the insulated substrate and the conductor pattern, due to the repeated a thermal expansion and a thermal contraction of the resistor. Therefore, although the ceramics substrate generally has excellent heat resistance, there is a concern that the durability of the entire resistor may decrease.

On the other hand, there is a method of bonding the resistance body to the ceramics substrate through a resin material such as polyimide or epoxy to facilitate heat dissipation from the resistance body through the ceramics substrate as a structure to adhere the resistance body to the insulated substrate.

In this case, although the thermal stress is moderated, the heat from the resistance body is blocked by the resin material and making it difficult to transfer the heat to the ceramics substrate. Therefore, when the amount of heat generated is large, it may not be possible to achieve sufficient heat dissipation.

In contrast, the resistor 1 according to the present embodiment, by providing the above structure, has a heat dissipation property at a higher level. Further, it is possible to accommodate the changing rate of the resistance temperature coefficient within a predetermined range, it is possible to stabilize the resistance characteristics.

The embodiments of the present disclosure are described above. However, each of the above embodiments only shows one of application examples of the present disclosure and there is no intention to limit the technical scope of the present disclosure to the specific configurations of the embodiments described above.

The invention claimed is:

1. A resistor comprising:

an insulated substrate formed using at least one ceramic material;

a resistive layer formed of a resistance body material; and a bonding layer for bonding the insulated substrate and the resistive layer, wherein the resistor is configured so that a ratio of a sheet resistance of the bonding layer to a sheet resistance of the resistive layer is 100 or more.

2. The resistor according to claim 1, wherein the bonding layer is formed of at least one metallic material selected from the group consisting of titanium, aluminum, nickel and chromium.

3. The resistor according to claim 2, wherein the resistance body material is a manganin-alloy.

4. The resistor according to claim 1, wherein a thickness of the resistive layer is 20 μm or more and 1000 μm or less.

5. The resistor according to claim 1, wherein a thickness of the bonding layer is 50 nm or more and 1000 nm or less.

6. The resistor according to claim 1, wherein the bonding layer is formed of a material containing titanium.

7. The resistor according to claim 1, further comprising a conductor layer formed on the surface of the bonding layer with overlapped on a portion of the resistive layer.

8. The resistor according to claim 7, wherein the bonding layer, the resistive layer and the conductor layer laminated on the insulated substrate in this order on the overlapped portion the conductor layer and the resistive layer.

9. The resistor according to claim 7, wherein the bonding layer, the conductor layer and the resistive layer laminated on the insulated substrate in this order on the overlapped portion the conductor layer and the resistive layer.

10. A circuit substrate formed a circuit pattern on an insulated substrate is formed using at least one ceramic material comprising:

a resistive layer formed of a resistance body material; and a bonding layer for bonding the insulated substrate and the resistive layer, wherein the circuit substrate is configured so that a ratio of a sheet resistance of the bonding layer to a sheet resistance of the resistive layer is 100 or more.

* * * * *